US005452066A

United States Patent [19]

Marotta et al.

[11] Patent Number: 5,452,066

[45] Date of Patent: Sep. 19, 1995

[54] SHUTTER SEAL ASSEMBLY

[75] Inventors: Joseph J. Marotta, Webster; Bruce C. Reynolds, Rochester, both of N.Y.

[73] Assignee: Xerox Corporation, Stamford, Conn.

[21] Appl. No.: 157,514

[22] Filed: Nov. 26, 1993

[51] Int. Cl.[6] ..... G03G 15/00; G03G 21/00

[52] U.S. Cl. ..... 355/298; 355/200; 355/260

[58] Field of Search ..... 355/200, 210, 260, 298; 222/DIG. 1

[56] References Cited

U.S. PATENT DOCUMENTS

| | | | |
|---|---|---|---|
| 3,985,436 | 10/1976 | Tanaka et al. | 355/200 |
| 4,556,308 | 12/1985 | Hoppner et al. | 355/200 |
| 4,849,791 | 7/1989 | Hagihara et al. | 355/298 |
| 4,924,920 | 5/1990 | Bhagwat | 355/260 X |
| 4,937,625 | 6/1990 | Kato et al. | 355/260 X |
| 4,941,022 | 7/1990 | Ohmura et al. | 355/298 |
| 5,111,246 | 5/1992 | Brailsford et al. | 355/245 |
| 5,126,799 | 6/1992 | Matsuura et al. | 355/298 |
| 5,132,740 | 7/1992 | Okamoto et al. | 355/298 |
| 5,285,250 | 2/1994 | Yoshioka | 355/298 |

*Primary Examiner*—Fred L. Braun

[57] ABSTRACT

A shutter seal assembly for opening and sealing an aperture on a surface including a frame having raised mounting ridges along its periphery on a first side, an aperture through the frame from the first side to a second side for communication with a dispensing device on the second side and a storage chamber on the first side, a pair of mounting pivot pins on the first side. Two integral shutter spring seal members on the first side each including a cover portion at one end to cover at least one half of the aperture and shutter seal arms at the opposite end to support the cover potions; each of the arms being mounted on one of the mounting pivot pins through pivot pin mounting holes at the ends, each of the shutter seal arms having integral compression spring elements compression loaded against the raised ridges to maintain the cover potions in sealing contact over the aperture, the shutter seal arms being in contact adjacent the cover portions and being tapered to form a V-like opening at the end, the raised ridges being discontinuous adjacent the V-like opening to enable the insertion of an aperture opening actuator to force the shutter seal arms apart toward the raised ridges to move the cover portions to the open position away from the aperture.

14 Claims, 4 Drawing Sheets

SHUTTER SEAL ASSEMBLY

CROSS REFERENCE TO RELATED APPLICATION

Attention is directed to U.S. application Ser. No. 07/997,047 entitled "Removable Process Unit With Waste Toner Storage" in the name of Thomas, filed Dec. 28, 1992, now U.S. Pat. No. 5,341,200.

BACKGROUND OF THE INVENTION

The present invention is directed to a shutter seal assembly for opening and sealing an aperture on a surface. It has particular application for use in electrostatographic printing apparatus and in particular to a storage sump for the storage of toner cleaned from a photoreceptor, and in particular, is united with a new toner dispensing container to form a removable process unit which performs two functions that are the supply of new toner and the storage of waste or spent toner.

Recently there has been a tendency in the design of electrostatographic printing apparatus to place one or more of the functional units such as a photoconductor drum or developer housing in a removable processing cartridge or unit so that the customer or operator of the printing machine may replace a functional unit when it's lifetime has been exhausted or a different processing parameter such as toner color is desired. Exemplary of such machines are those described and illustrated, for example, in U.S. Pat. No. 3,985,436 to Tanaka et al., U.S. Pat. No. 4,556,308 to Hoppner et al. and U.S. Pat. No. 5,111,246 to Brailsford et al., all of which are hereby incorporated in their entirety herein by reference. Accordingly, the removable processing cartridges may be designed to contain a photoreceptor, a developing device, a cleaning device as well as a charging device. Alternatively, instead of placing all of the functional elements in a single processing cartridge there may be two or more processing cartridges wherein, for example, the photoreceptor, cleaning device and charge device are in one removable processing cartridge while the developer device is in another removable processing cartridge.

There is a desire, particularly with the smaller electrostatographic printing machines, to make these removable process units or cartridges as small as possible: Accordingly, the capacity of a cleaner sump, for example, in such a removable process unit may be diminished to accommodate this desire for compactness. One way to maintain the copiers and printers as compact as possible and still increase the capacity to store the cleaned toner is that illustrated and described in the above referenced copending application.

PRIOR ART

FIG. 1A illustrates such an embodiment wherein a cleaned toner storage sump 10 is affixed to the end of a toner replenisher tube or cartridges 12 filled with new toner. Toner cleaned from the photoreceptor is transported toward the end of the machine wherein the cleaned toner sump is further transported by means of an auger from the cleaned sump in the photoreceptor housing to the cleaned toner sump 10 affixed to the toner cartridge 12. When the removable cartridge is inserted into the developer housing a shutter seal 14 on the cleaned toner sump slides inboard and outboard to open and close the waste toner sump that is connected to the toner cartridge. Initially the shutter is located in the closed outboard position as illustrated in FIGS. 1A and 1B and when the toner cartridge is inserted into the machine the shutter is pushed to the open position (See FIG. 1C) by the cover front actuator 16 on the developer housing 21 (See FIGS. 6 and 7) which allows waste toner from the toner augering system located in the photoreceptor unit to deposit through the aperture 17 in the seal through the aperture 20 into the sump 10 located on the front of the toner cartridge 12. The shutter seal remains open until the toner cartridge is removed from the machine. Upon removal of the toner cartridge from the machine the molded catch feature 19 on the front of the actuator 16 which is hooked into the shutter seal 14, is intended to pull the shutter seal to the closed position. However, many difficulties have been experienced with this mechanism in that the slide feature on the shutter seal skews to one side or the other during removal and/or insertion thereby increasing the insertion and/or removal force. In addition, the shutter seal can malfunction during insertion remaining closed, partially closed, causing premature photoreceptor failure. Finally, and most frequently the shutter seal can malfunction during removal remaining in the open position thereby providing the potential for the dumping of toner onto a customer's floor and/or clothing.

SUMMARY OF THE INVENTION

In accordance with a principle aspect of the present invention a shutter seal assembly for automatically and accurately opening and sealing an aperture on the surface by insertion and removal of a device from an operative to an inoperative position is provided.

In a further aspect of the present invention the shutter seal assembly comprises a frame having raised mounting ridges along it's periphery on a first side, an aperture through the frame from the first side to a second side for communication with a dispensing device on the second side and the storage chamber on the first side. The frame has a pair of mounting pivot pins on the first side, two integral shutter spring seal members on the first side, each comprising a portion at one end to cover at least one half of the aperture and shutter seal arms at the opposite end to support the cover portions, each of the arms being mounted on one of the mounting pivot pins through pivot pin mounting holes at the ends thereof, each of the shutter seal arms having integral compression spring elements, compression loaded against the raised ridges to maintain the cover portions in sealing contact over the aperture, the shutter seal arms being in contact adjacent the cover portions and being tapered to form a V-like opening at the end. The raised ridges being discontinuous adjacent the V-like opening enable the insertion of an aperture opening actuator therein to force the shutter seal arms apart toward the raised ridges thereby moving the cover portions to the open position away from the aperture.

In a further aspect of the present invention the integral shutter spring seal members are integrally molded plastic and compression spring elements are on the opposite side of the V-like opening formed by the shutter seal arms and are positioned between the pivot pin mounting holes and the beginning of the shutter seal arm taper.

In a further aspect of the present invention the shutter seal assembly is rectangular in shape and the mounting pins are at two corners adjacent to each other and the aperture is at the end of the rectangle opposite the two adjacent corners.

In a further aspect of the present invention a locating pin is provided at the opposite end of the rectangle which is engageable with substantially semicircular formations in each of said shutter spring seal members in mating engagement with said locating pin.

In a further aspect of the present invention the integrally molded spring seal members are identical to each other, one being reversed in lateral orientation relative to the other.

In a further aspect of the present invention the frame and raised ridges are integrally molded and include surface means integrally molded on the second side to receive material to pass through the aperture when it is opened.

In further aspect of the present invention the surface may be either planar or arcuate and said shutter seal assembly is fastened to a storage sump for particulate material, which in turn is integral with a new toner dispensing container for a developer in an electrostatographic printing apparatus.

For a better understanding as well as other objects and further features thereof reference is made to the following drawings and descriptions.

DESCRIPTION OF PREFERRED EMBODIMENT

Figure 1A:
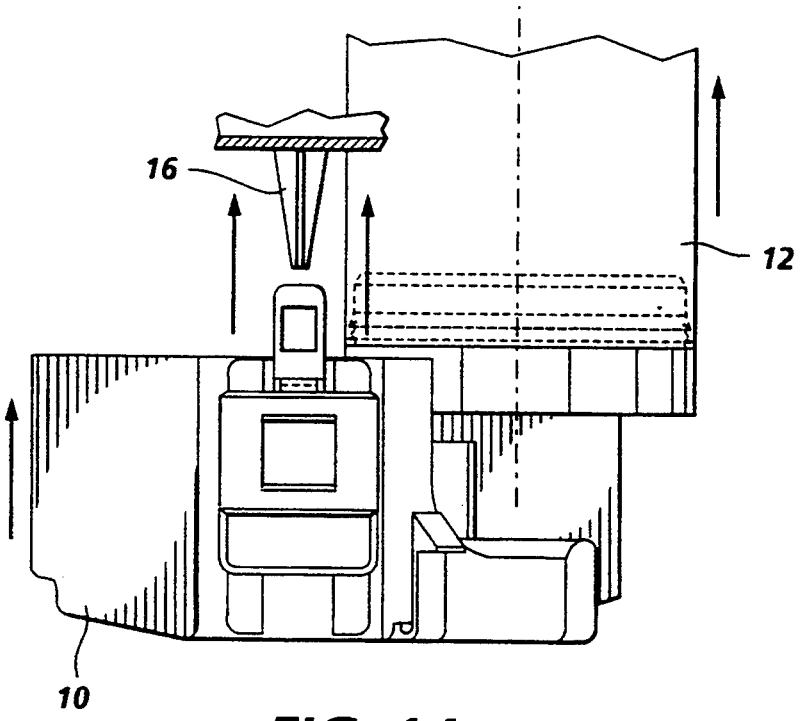
FIG. 1A PRIOR ART
FIGS. 1A, 1B and 1C are representations of the shutter mechanism according to the prior art.
Figure 1B:
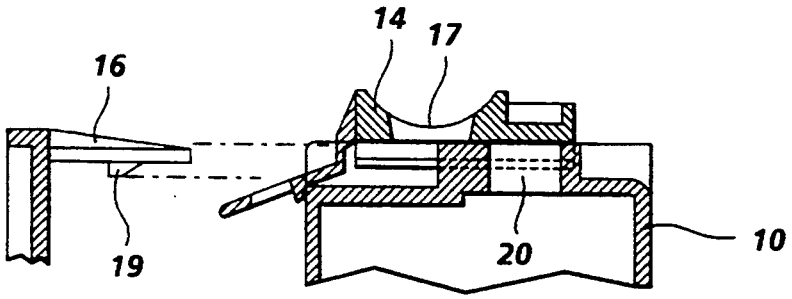
FIG. 1B PRIOR ART
Figure 1C:
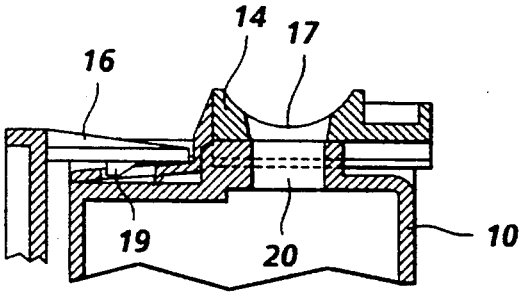
FIG. 1C PRIOR ART
Figure 2:
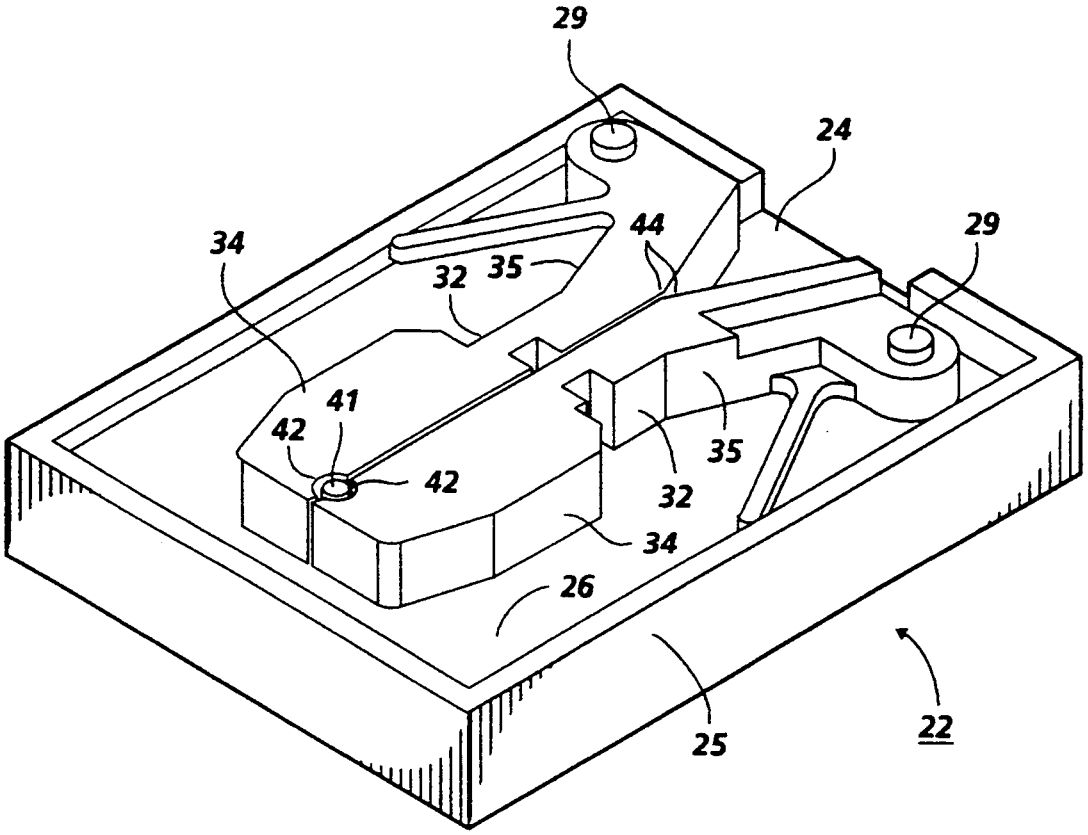
FIG. 2 is an isometric representation of the shutter seal assembly according to the present invention.
Figure 3:
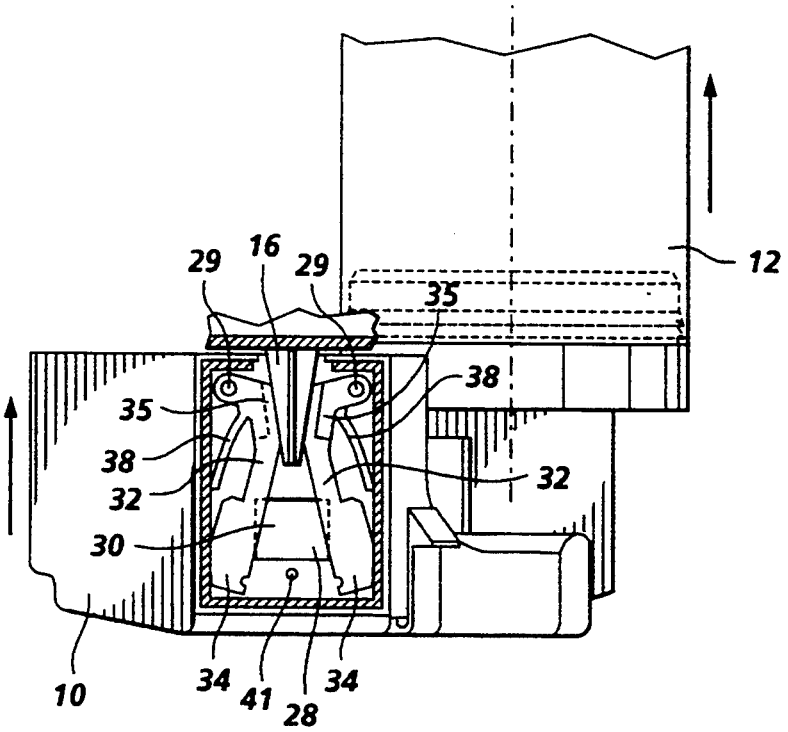
FIG. 3 is an illustration of the shutter seal assembly according to the present invention with a shutter in the open position.
Figure 4:
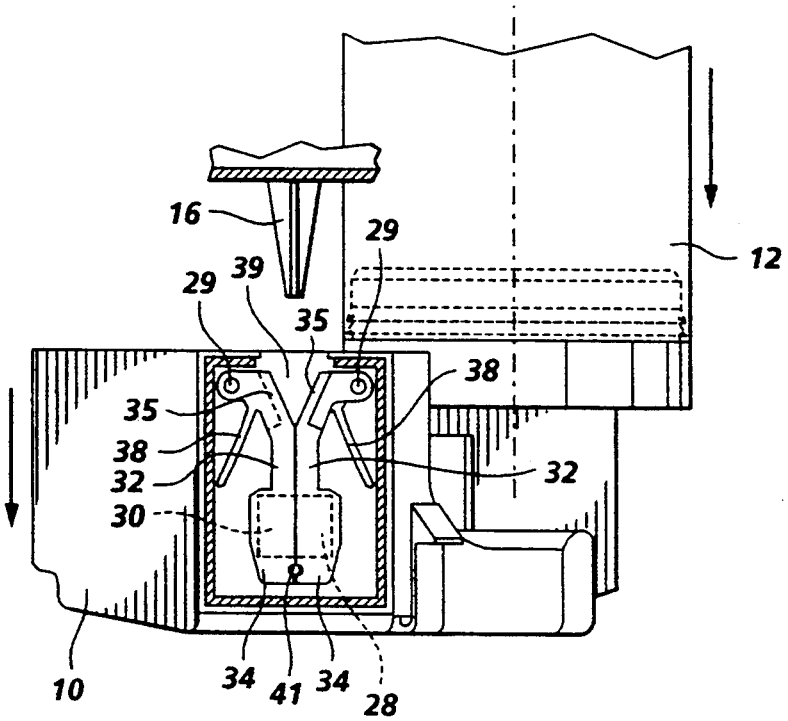
FIG. 4 is an illustration of the shutter seal assembly according to the present invention with the shutter being in the closed position.
Figure 5:
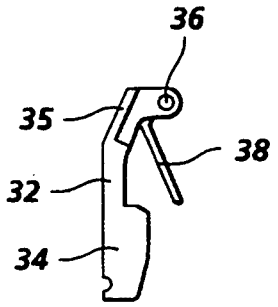
FIG. 5 is an illustration of one shutter spring seal member.

The shutter seal assembly according to the present invention will be described with particular reference to FIGS. 2, 3, 4, 5, and 7. For ease of understanding common reference numerals used to describe the prior art will be used to describe the shutter seal assembly according to the present invention. The shutter seal assembly 22 according to the present invention can be used to seal an aperture in a surface and in particular a planar surface. However, it may have associated with it integrally molded means on the second side to receive material to pass through the aperture when it is opened. The shutter seal assembly includes a frame 24 which may be integrally molded having raised mounting ridges 25 along the periphery on it's first side 26, an aperture 28 (see dotted line representation in FIGS. 3 and 4) from the first side to the second side for communication with a dispensing device on the second side. While the shutter seal assembly may take many forms and typically is in the form of a rectangle having mounting pivot pins 29 on a first side at two adjacent corners and wherein the aperture is at the opposite end 30 of the rectangle from the mounting pivot pins 29. The shutter seal assembly 22 also includes separate but integrally molded springs seal members 32 on the first side which have a cover portion 34 at one end which will cover at least one half of the aperture and has shutter seal arms 35 at the end opposite to support the cover portions. The arms are mounted on mounting pins 29 at the end of the frame opposite the aperture 28 through pivot pin mounting holes 36 in the end of the shutter seal arms 35. Compression spring elements 38 here illustrated in the form of a leaf spring are compression loaded against the raised mounting ridges 25 to maintain the cover portions in sealing contact over the aperture. The integrally molded spring seal members are identical being made from the same mold and are reversed in lateral orientation relative to each other when placed at the shutter seal assembly. The arms 35 are in contact adjacent the cover portions and are somewhat tapered to form a V-like opening 39 at the end where they are mounted on the pivot pins. The raised mounting ridges are discontinuous adjacent V-like opening to enable insertion of an aperture opening actuator 16 to force the shutter seal arms 35 apart toward the raised ridges thereby moving the cover portions 34 to the open position away from the aperture 28. A locating pin 41 is provided at the opposite end of the shutter seal arms 35 and is in mating engagement with a semicircular shape formation 42 on each of the shutter spring seal members. As illustrated the compression spring elements 38 are leaf springs on the opposite side of the V-like opening formed of the shutter seal arms and are positioned between the pivot pin mounting holes 29 and the beginning of the shutter seal taper 44.

In operation the shutter seal assembly is in the closed position with the shutter seal arms being urged by the compression spring elements compression loaded against the raised ridges to provide the cover portions in place over the aperture. Upon insertion of a cover front actuator, into the V-like opening formed by the shutter seal arms, the arms are forced apart toward the raised ridges thereby moving the cover portions to the open position away from the aperture.

Figure 6:
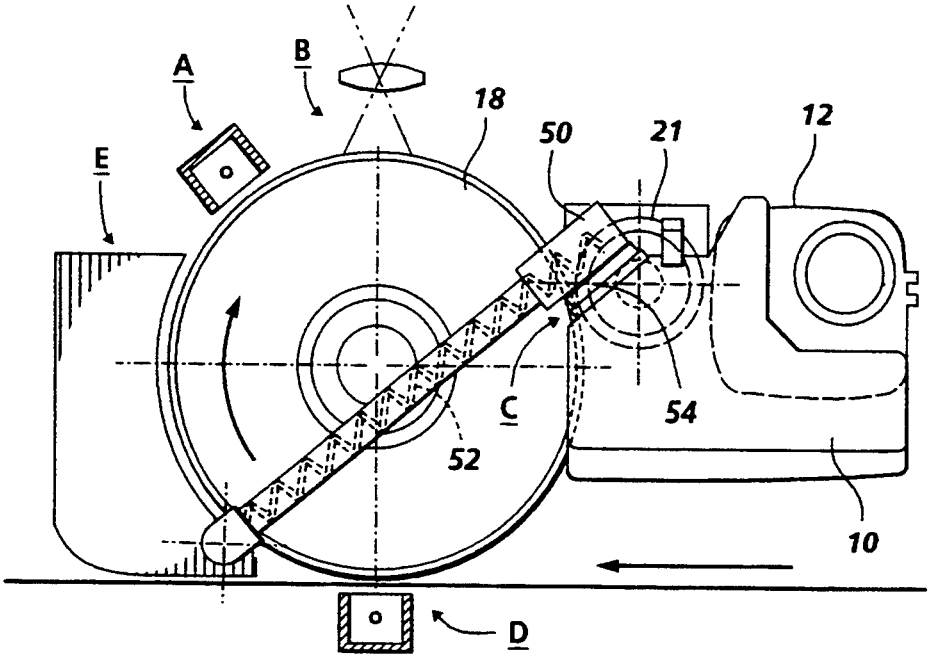
FIG. 6 is an end view of a portion an electrostatographic apparatus which may be used in the practice of the present invention.
Figure 7:
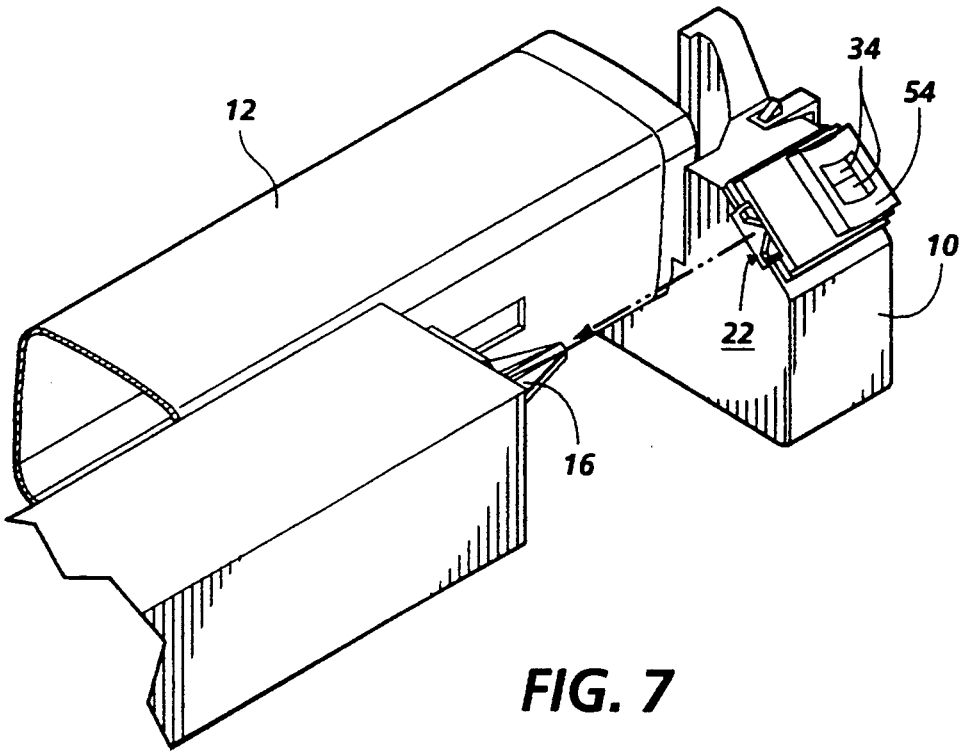
FIG. 7 is an illustration of the combined waste toner storage tube and the toner delivery tube which comprise a removable process unit in the device illustrated in FIG. 6.

With continued reference to FIGS. 6 and 7 a specific application of the shutter seal assembly according to the present invention will be described. FIG. 6 illustrates schematically an automatic electrostatographic printing apparatus which may employ a removable process unit (i.e. new toner supply container) cleaned waste toner storage container useful in the practice of the present invention. It will be understood that although the present invention is particularly well suited for use in automatic electrostatographic printing apparatus it is equally well adapted for use with any number of other devices in which material may be stored.

With particular reference to FIG. 6 the printer includes a photosensitive drum 18 which is rotated in the direction indicated by the arrow to pass sequentially through a series of xerographic processing stations; a charging station A, an imaging station B, a developer station C, a transfer station D and a cleaning station E.

The basic operation of the automatic printing apparatus for example may reproduce a document placed on imaging platen and scanned by moving optical system including a lamp and mirrors and lens to produce a flowing light image on the drum surface which had been charged at charging station A. The image is then developed at development station C to form a visible toner image. FIG. 7 is an isometric illustration of the new toner replenisher tube 18 having attached to one end a cleaned waste toner storage chamber 10 including the shutter seal assembly 22 according to the present invention. Upon insertion of the removable process unit into the developer housing an aperture opening actuator 16 on the developer housing is inserted into the V-like opening at the end of the shutter seal assembly thereby forcing the shutter seal arms apart toward the raised ridges and moving the cover portions to the open position away from the aperture. In this position the aperture and the shutter seal assembly housing is in the open position and on one side in communication with the interior of the cleaned toner sump 10 and on the other side in communication with a cleaned toner delivery tube 50 (See FIG. 6) having an auger mechanism 52 which delivers cleaned toner from the cleaner sump E adjacent the photoreceptor to the opened aperture in the receiving member 54 on the cleaned toner sump 10 attached to the new toner delivery tube 12.

Thus, according to the present invention a simple low cost shutter seal assembly for opening and sealing an aperture on a surface has been provided which is normally in the sealing position but is readily actuatable to the open position when inserted into a developer housing with a front actuator feature located on the developer housing. As the cartridge enters the developer housing the shutter seal assembly upon contacting the tapered features on the shutter seal arms forces the shutter seal arms open thereby opening the toner receiver hole for receiving the waste toner from the cleaner and upon removal of the toner cartridge from the machine the cover front actuator disengages from the shutter seal arms allowing the compression loaded springs to return the shutter seal arms to the closed position covering the toner receiver hole. With the toner cartridge removed and the sump full of waste toner the spring mechanics of the shutter seal mechanism keep the shutter seal arms closed thereby eliminating the possibility of toner spillage within the customer environment.

All the patents together with other references the copending application referred to herein are hereby specifically and totally incorporated herein by reference.

Thus, according to the present invention a printing apparatus with deferred jam clearance is provided. Furthermore, while the invention has been described with regard to electrostatographic printing apparatus, it will be understood that it has equal application to other types of printing and sheet handling devices. Furthermore, while the invention has been described with reference to a copier it has equal application to other machines such as printers where the image is electronically generated. Accordingly, it is intended to embrace all such alternatives and modifications as may fall within the spirit and scope of the appending claims.

We claim:

1. A shutter seal assembly for opening and sealing an aperture on a surface comprising a frame having raised mounting ridges along its periphery on a first side; an aperture through said frame from said first side to a second side for communication with a dispensing device on said second side and a storage chamber on the first side; a pair of mounting pivot pins on said first side, two integral shutter spring seal members on said first side each comprising a cover portion at one end to cover at least one half of said aperture and shutter seal arms at the opposite end to support said cover portions; each of said arms being mounted on one of said mounting pivot pins through pivot pin mounting holes at the ends thereof, each of said shutter seal arms having integral compression spring elements compression loaded against said raised ridges to maintain said cover portions in sealing contact over said aperture, said shutter seal arms being in contact adjacent said cover portions and being tapered to form a V-like opening at the end, said raised ridges being discontinuous adjacent said V-like opening to enable the insertion of an aperture opening actuator therein to force the shutter seal arms apart toward the raised ridges thereby moving the cover portions to the open position away from said aperture.

2. The shutter assembly of claim 1 wherein said integral shutter spring seal members are integrally molded plastic.

3. The shutter seal assembly of claim 2 wherein each of said integrally molded spring seal members are identical to each other, one being reversed in lateral orientation relative to the other.

4. The shutter seal assembly of claim 1 wherein it is rectangular in shape said mounting pivot pins are at two corners adjacent to each other and said aperture is at the end of said rectangle opposite said two adjacent corners.

5. The shutter seal assembly of claim 4 further including a locating pin at the opposite end of said rectangle which is engageable with substantially semicircular formations in each of said shutter spring seal members in mating engagement with said locating pin.

6. The shutter seal assembly of claim 1 wherein said compression springs elements are on the opposite side of the V-like opening formed by the shutter seal arms and are positioned between the pivot pin mounting holes and the beginning of the shutter seal arm taper.

7. The shutter seal assembly of claim 1 wherein said surface is planar.

8. The shutter seal assembly of claim 7 wherein said frame and raised ridges are integrally molded and includes integrally molded means on the second side to receive material to pass through said aperture when it is open.

9. The shutter seal assembly of claim 8 wherein said integrally molded means is arcuate.

10. The shutter seal assembly of claim 8 wherein said integrally molded means is spent toner receiving means from a cleaner station in an electrostatographic printing machine.

11. The shutter seal assembly of claim 10 wherein said integrally molded means is arcuate, said shutter seal assembly is fastened to a storage sump for particulate material which in turn is integral with a new toner dispensing container for a developer in an electrostatographic printing apparatus.

12. The shutter seal assembly of claim 11 wherein said storage sump and said new toner dispensing container comprise a removable process unit.

13. The shutter seal assembly of claim 1 wherein it is fastened to a storage sump.

14. The shutter seal assembly of claim 13 wherein said storage sump is for particulate material.

* * * * *